US008336268B2

(12) United States Patent
Delaquis

(10) Patent No.: US 8,336,268 B2
(45) Date of Patent: Dec. 25, 2012

(54) FLOOR DRAINAGE SYSTEM FOR A BUILDING AND ASSEMBLY THEREFOR

(76) Inventor: Daniel N. J. Delaquis, Vancouver (CA)

( * ) Notice: Subject to any disclaimer, the term of this patent is extended or adjusted under 35 U.S.C. 154(b) by 303 days.

(21) Appl. No.: 12/698,475

(22) Filed: Feb. 2, 2010

(65) Prior Publication Data

US 2011/0185657 A1 Aug. 4, 2011

(51) Int. Cl.
*E04F 17/00* (2006.01)

(52) U.S. Cl. ..... 52/302.1; 52/11; 49/471

(58) Field of Classification Search ..... 52/302.1, 52/169.5, 302.3, 236.3, 11, 12, 13, 14, 15; 49/467, 468, 469, 470, 471; 210/163, 164, 210/165, 166

See application file for complete search history.

(56) References Cited

U.S. PATENT DOCUMENTS

| | | | | | |
|---|---|---|---|---|---|
| 2,340,926 | A * | 2/1944 | Bradley | 285/124.5 |
| 2,701,027 | A * | 2/1955 | Scoville | 210/163 |
| 3,426,487 | A * | 2/1969 | Forte | 52/1 |
| 3,973,407 | A * | 8/1976 | Vecchio | 210/136 |
| 4,478,017 | A * | 10/1984 | Brown et al. | 52/209 |
| 4,640,643 | A * | 2/1987 | Williams | 404/4 |
| 4,831,779 | A * | 5/1989 | Kehrli et al. | 49/471 |
| 5,067,279 | A * | 11/1991 | Hagemeyer | 49/471 |
| 5,179,804 | A * | 1/1993 | Young | 49/471 |
| 5,529,436 | A * | 6/1996 | Meyers | 405/119 |
| 5,551,797 | A * | 9/1996 | Sanford | 405/36 |
| 5,584,142 | A * | 12/1996 | Spiess | 49/411 |
| 5,729,937 | A * | 3/1998 | Mantelli | 52/220.5 |
| 5,800,260 | A * | 9/1998 | Kao | 454/370 |
| 5,836,815 | A * | 11/1998 | Jennemann | 454/341 |
| 5,915,408 | A * | 6/1999 | Dudley | 137/244 |
| 5,956,909 | A * | 9/1999 | Chou | 52/209 |
| 6,129,838 | A * | 10/2000 | Millner | 210/164 |
| 6,132,318 | A * | 10/2000 | Briggs | 472/128 |
| 6,192,915 | B1 * | 2/2001 | Valperz et al. | 137/172 |
| 6,276,093 | B1 * | 8/2001 | Janesky | 52/19 |
| 6,371,188 | B1 * | 4/2002 | Baczuk et al. | 160/92 |

(Continued)

FOREIGN PATENT DOCUMENTS

GB 247367 2/1926

(Continued)

OTHER PUBLICATIONS

English Translation of the Abstract for KR 100689221 B1.

(Continued)

*Primary Examiner* — William Gilbert
*Assistant Examiner* — James Ference
(74) *Attorney, Agent, or Firm* — Cameron IP

(57) ABSTRACT

There is provided a floor drainage assembly for inhibiting water from passing from an upper floor of a building to lower floors of the building. The floor drainage assembly includes a stairwell drain and a stairwell trough connected to the drain. The stairwell trough extends along the stairwell threshold. Water from the upper floor entering the stairwell threshold is at least partially captured by the stairwell trough and directed to the stairwell drain. The assembly inhibits the water from damaging lower floors thereby. An angled threshold plate that is isosceles trapezoid shaped in cross-section may extend across the stairwell drain. The floor drainage assembly may also include a hoistway drain and a hoistway trough extending along the hoistway threshold. Water from the upper floor entering the hoistway threshold is at least partially captured by the hoistway trough and directed to the hoistway drain.

8 Claims, 10 Drawing Sheets

U.S. PATENT DOCUMENTS

| | | | | |
|---|---|---|---|---|
| 6,612,780 | B2 * | 9/2003 | Dahowski et al. | 405/118 |
| 6,669,404 | B2 * | 12/2003 | Le Blanc | 405/36 |
| 6,792,651 | B2 * | 9/2004 | Weiland et al. | 16/102 |
| 6,854,479 | B2 * | 2/2005 | Harwood | 137/362 |
| 7,066,685 | B2 * | 6/2006 | Humphries et al. | 405/43 |
| 7,100,632 | B2 * | 9/2006 | Harwood | 137/362 |
| 7,246,472 | B2 * | 7/2007 | Nielsen | 52/302.3 |
| 7,413,372 | B2 * | 8/2008 | Meyers | 404/2 |
| D579,531 | S * | 10/2008 | Musser | D23/261 |
| 7,506,844 | B2 * | 3/2009 | Humphries et al. | 248/48.1 |
| 7,507,054 | B2 * | 3/2009 | Fithian et al. | 405/118 |
| 7,588,392 | B2 * | 9/2009 | Wroblewski et al. | 405/118 |
| 7,637,694 | B1 * | 12/2009 | Musser | 405/118 |
| 7,748,170 | B1 * | 7/2010 | Pratt | 52/11 |
| 2002/0129577 | A1 * | 9/2002 | Weiss | 52/270 |
| 2002/0187005 | A1 * | 12/2002 | Le Blanc | 405/36 |
| 2003/0005653 | A1 * | 1/2003 | Sataka | 52/236.3 |
| 2003/0046888 | A1 * | 3/2003 | Ryan | 52/302.1 |
| 2003/0115814 | A1 * | 6/2003 | Nielsen | 52/302.1 |
| 2003/0177699 | A1 * | 9/2003 | Fukuro et al. | 49/408 |
| 2005/0210768 | A1 * | 9/2005 | Lawson et al. | 52/97 |
| 2006/0201088 | A1 * | 9/2006 | Swaffield et al. | 52/302.1 |
| 2007/0175112 | A1 * | 8/2007 | Janesky | 52/169.5 |
| 2008/0190045 | A1 * | 8/2008 | Janesky | 52/169.5 |
| 2008/0223471 | A1 * | 9/2008 | Guo | 138/113 |
| 2008/0236065 | A1 * | 10/2008 | Conservano | 52/185 |
| 2009/0217448 | A1 * | 9/2009 | Hall et al. | 4/431 |
| 2009/0218264 | A1 * | 9/2009 | Hall et al. | 210/134 |

FOREIGN PATENT DOCUMENTS

| | | | |
|---|---|---|---|
| GB | 394224 | | 6/1933 |
| GB | 2297112 | A | 7/1996 |
| GB | 2299607 | A | 10/1996 |
| GB | 2381287 | A | 4/2003 |
| JP | 53027938 | A | 3/1978 |
| JP | 6227773 | A | 8/1994 |
| JP | 8121035 | A | 5/1996 |
| JP | 9096175 | A | 4/1997 |
| JP | 10324485 | A | 12/1998 |
| JP | 2002003131 | A | 1/2002 |
| KR | 100689221 | B1 | 2/2007 |
| WO | WO 98/22381 | | 5/1998 |

OTHER PUBLICATIONS

English Translation of the Abstract for JP 53027938 A.
English Translation of the Abstract for JP 10324485 A.
English Translation of the Abstract for JP 9096175 A.
English Translation of the Abstract for JP 8121035 A.

* cited by examiner

FLOOR DRAINAGE SYSTEM FOR A BUILDING AND ASSEMBLY THEREFOR

FIELD OF THE INVENTION

The present invention relates to a floor drainage system and water containment system, hereinafter referred to as a floor drainage system. In particular and according to one aspect, the invention relates to a floor and pressurized stairwell drainage system for a building.

DESCRIPTION OF THE RELATED ART

Buildings can be vulnerable to water flooding. Water can flood an entire floor and/or proceed to flood subsequent, lower floors. This may occur, for example, as a result of water taps being left open, a catastrophic plumbing failure or fire sprinkler activation. It is well known that water flooding in a building is a nuisance that can lead to serious and oftentimes costly water damage.

It is known per se to have a drain channel at a hoistway threshold of an elevator to capture unwanted water. This is for example illustrated in International Publication Number WO 98/22381 to Allen. However the site-specific nature of such elevator drain channels may result in water bypassing such elevator drain channels.

This is particularly the case in areas of a floor that are relatively far from the elevator. Also, where unwanted water does pass by such elevator drain channels, the drain channels may become overwhelmed.

These factors may lead to water damage despite the above elevator drain channels. For example water damage may occur to the floor where the flooding originated. Also, uncontained water may be allowed to travel to lower floors, resulting in a further spreading of water damage.

BRIEF SUMMARY OF INVENTION

There is accordingly a need for an improved floor drainage system for a building that functions in a more comprehensive manner.

The present invention provides a floor drainage system for a building and an assembly therefor that overcome the above disadvantages. It is an object of the present invention to provide an improved floor drainage system for a building and an assembly therefor. More particularly, the present invention, according to one aspect, is directed to a floor drainage system for a building and an assembly therefor, that contain and remove unwanted water.

There is accordingly provided a threshold plate for extending along a door threshold. The door threshold connects a first room and a second room. The threshold plate has a first portion at least partially disposed towards the first room. A plurality of apertures extend through the first portion. The apertures are positioned to receive water passing over the threshold plate. The first portion is operatively connectable to a drain via the apertures. The threshold plate has a second portion at least partially disposed towards the second room. A plurality of apertures extend through the second portion. The apertures of the second portion are positioned to receive water passing over the threshold plate. The second portion is operatively connectable to a drain via the apertures of the second portion.

There is also provided a floor drainage assembly for inhibiting water from passing from one floor of a building to an other floor of the building. The one floor is disposed above the other floor. The one floor includes a stairwell threshold. The building has a stairwell connecting the one floor to the other floor. The one floor is in communication with the stairwell via the stairwell threshold. The floor drainage assembly includes a stairwell drain and a stairwell trough. The stairwell trough extends along the stairwell threshold. The stairwell trough is in fluid communication with the stairwell drain, whereby water from the one floor that enters the stairwell threshold is at least partially captured by the stairwell trough and directed to the stairwell drain. The assembly inhibits the water from damaging the other floor thereby.

There is further provided a building having a first floor and a second floor disposed above the first floor. The second floor includes a stairwell threshold. The building includes a stairwell connecting the first floor to the second floor. The second floor is in communication with the stairwell via the stairwell threshold. The building includes a floor drainage assembly. The floor drainage assembly has a stairwell drain extending below the second floor. The floor drainage assembly has a stairwell trough extending along the stairwell threshold. The stairwell trough is in fluid communication with the stairwell drain, whereby water from the second floor that enters the stairwell threshold is at least partially captured by the stairwell trough and directed to the stairwell drain.

According to another aspect of the invention, the above described building further includes a hoistway connecting the first floor to the second floor. The second floor further has a hoistway threshold. The second floor is in communication with the hoistway via the hoistway threshold. The assembly further includes a hoistway trough extending adjacent to the hoistway threshold. The hoistway trough is in fluid communication with a hoistway trough drain, whereby water from the second floor that seeks to enter the hoistway threshold is at least partially captured by the hoistway trough and directed to the hoistway trough drain.

There is yet further provided a building having a first room with a first threshold and a second room with a second threshold. The building has a connecting room connecting the first room to the second room. The first room and the second room are in communication with the connecting room via the first threshold and the second threshold, respectively. The building has a floor drainage assembly. The floor drainage assembly includes a first drain and a first trough extending along the first threshold. The first trough is in fluid communication with the first drain. The floor drainage assembly has a second drain. The floor drainage assembly has a second trough extending along the second threshold. The second trough is in fluid communication with the second drain. Thus, water from the first room that enters the first threshold is at least partially captured by the first trough and directed to the first drain. Also, water from the second room that enters the second threshold is at least partially captured by the second trough and directed to the second drain. The assembly thereby inhibits water from passing from one of the first room or the second room to the other of the first room or the second room.

There is even further provided a method of arranging a floor drainage system for a building. The building has a first floor and a second floor disposed above the first floor. The building has a stairwell connecting the first floor to the second floor. The building has a stairwell threshold interposed between the second floor and the stairwell.

The method includes providing a stairwell trough that extends along the stairwell threshold. According to one preferred embodiment the method further includes within the providing step, casting the stairwell trough and then positioning the stairwell trough as cast to extend along the stairwell threshold. The method includes connecting a stairwell drain to the stairwell trough, whereby water reaching the stairwell threshold is at least partially captured by the stairwell trough and directed to the stairwell drain.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
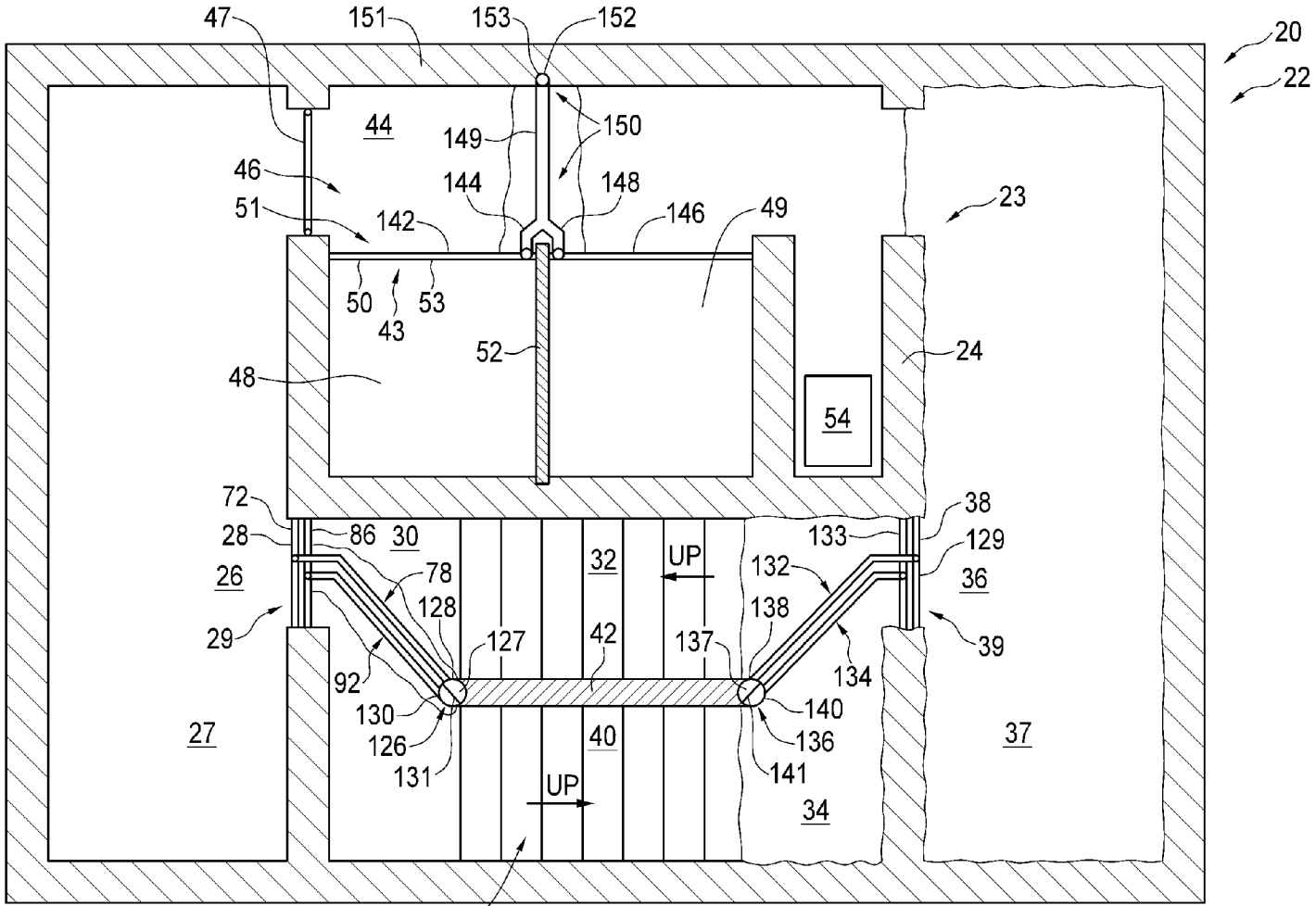
FIG. 1 is a fragmentary, cross-sectional top view of a second floor of a building that includes a stairwell and a hoistway, with the second floor at least partially broken away to show features of a floor drainage system.

Referring to FIG. 1, there is shown a fragmentary, cross-sectional view of a floor, in this example, a second floor 22 of a building 20. There is also provided a floor drainage system 23 partially shown in FIG. 1.

For the sake of clarity the second floor 22 and the building 20 will first generally be described. The building 20 includes a structure in this example a concrete structure 24. The second floor 22 includes a first room 26, which in this example is part of a suite 27. The various interior walls, features and enclosures of the first room 26/the suite 27 are not relevant and therefore not shown. The first room 26/suite 27 alternatively could be a hallway with suites in fluid communication with the hallway. Building layouts per se are well known and therefore will not be described further.

The second floor 22 includes a first stairwell threshold 28.

The floor drainage system 23 includes a first stairwell drainage assembly 29.

The first stairwell drainage assembly 29 in this example partially extends to the first stairwell threshold 28 and will be discussed in further detail below.

The building 20 has a stairwell 31. The stairwell 31 includes a second room or landing 30. The landing 30 in this example is at the level of the second floor 22. The suite 27 and the landing 30 are connected and in communication with each other via the first stairwell threshold 28. The stairwell 31 includes stairs 32 that connect to a lower floor (not shown), in this case by way of the landing 30. The stairs 32 increase in elevation from right to left, from the perspective of FIG. 1. The stairwell 31 also includes stairs 40 that connect to a third floor, which is not shown. The stairs 40 increase in elevation from left to right, from the perspective of FIG. 1. The building 20 includes a stairwell divider wall 42 that divides the stairwell. Stairwell divider wall 42 is interposed between stairs 32 and stairs 40.

The third floor landing is shown via broken away foundation 34. The building 20 also includes a second room 36, which in this example is part of an additional suite 37 on the third floor. The second room 36 and the additional suite 37 are also shown via broken away foundation. The second room 36/suite 37 alternatively could be a hallway with suites in fluid communication with the hallway. Building layouts per se are well known and therefore will not be described further. Also the various walls, features and enclosures of the second room 36 and the additional suite 37 are not relevant and therefore not shown. The additional suite 37 and the foundation 34 are connected and in communication with each other via a second stairwell threshold 38. The stairwell 31 functions as a connection room between suites 27 and 37.

The floor drainage system 23 includes a second stairwell drainage assembly 39. The second stairwell drainage assembly 39 in this example partially extends to the second stairwell threshold 38 and will be discussed in further detail below.

The building 20 may include a vent duct 54. The floor drainage system 23 may include flashing around the vent duct 54 and other such waterproofing to inhibit water from passing therein and therethrough.

The building 20 in this example includes a hoistway assembly in this example an elevator assembly 46. The elevator assembly 46 comprises a first hoistway 48, a second hoistway 49 and a support member in this example a steel I-beam 52 interposed between the first hoistway 48 from the second hoistway 49. Elevators per se are well known to those skilled in the art and thus their parts and functioning will not be discussed in great detail. The second floor 22 includes an elevator lobby 44. The suite 27 is in communication with the elevator lobby 44 via door 47. The second floor 22 includes a hoistway threshold 43 that extends adjacent to both the first hoistway 48 and the second hoistway 49. Both the first hoistway 48 and the second hoistway 49 are connected to and in communication with the elevator lobby 44 via the hoistway threshold 43.

The floor drainage system 23 includes a hoistway drainage assembly 51. The hoistway drainage assembly 51 is shown adjacent to hoistway threshold 43 and will be discussed in further detail below.

The floor drainage system 23 will now be described in greater detail, beginning first with the first stairwell drainage assembly 29.

Figure 3:
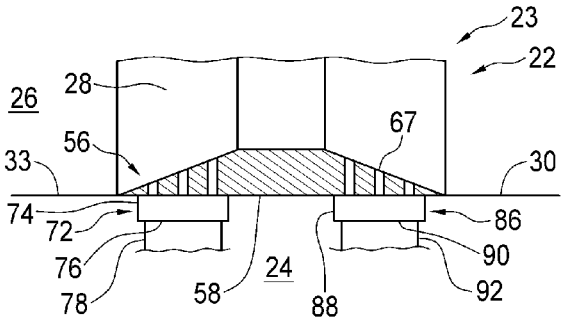
FIG. 3 is a cross-sectional end view of the threshold plate shown in FIG. 2 extending across the door threshold and a fragmentary end view of features of the floor drainage system shown in FIG. 2.
Figure 2:
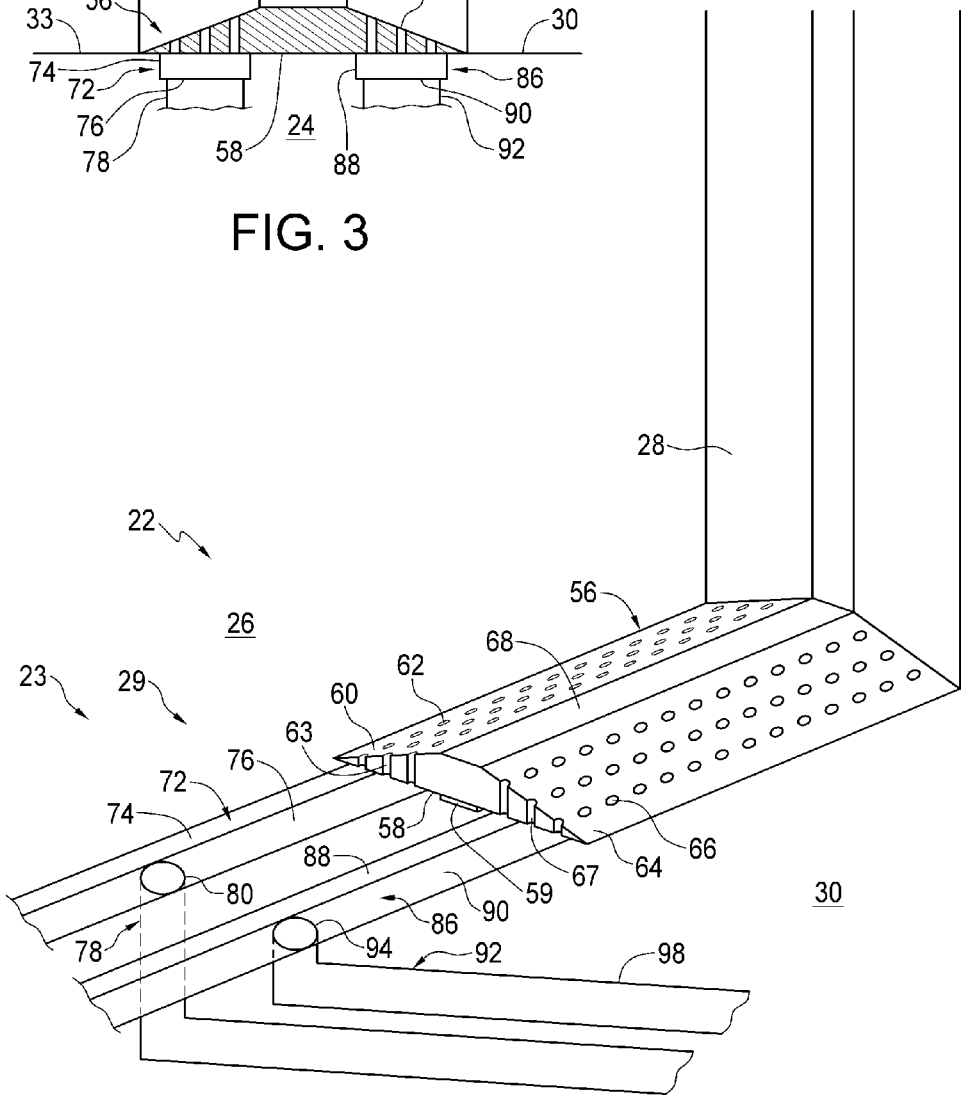
FIG. 2 is a fragmentary, top, side perspective view of a threshold plate, shown partially broken away, extending along a door threshold, with other features of the floor drainage system according to the embodiment of FIG. 1 also shown.

Referring to FIG. 2, the first stairwell drainage assembly 29 in this example includes a threshold plate 56, shown in fragment. The threshold plate 56 is not shown in but is a part of the system of FIG. 1. The threshold plate 56 extends across and along the first stairwell threshold 28. As best shown in FIG. 3, the threshold plate 56 has a base 58 that abuts floor 33 of the first room 26. The base 58 also abuts landing 30.

Referring to FIG. 2, the threshold plate 56 in this example includes a seal 59 connected to the base 58. The seal 59 extends longitudinally along the base 58 of the threshold plate 56 and abuts the floor. The seal 59 thereby inhibits water from passing between the base 58 and the floor, from the floor 33 to landing 30, and vice versa. The seal 59 is not shown in FIG. 3.

The threshold plate 56 has a first portion, in this example a first angled portion 60. The first angled portion 60 extends upwards from the base 58 from left to right, from the perspective of FIG. 3. The first angled portion 60 at least partially faces the first room 26.

Referring back to FIG. 2, the first angled portion 60 has a plurality of apertures 62. The apertures 62 are positioned upwards from the perspective of FIG. 2 and are shaped and positioned to receive water that, for example, originates from the first room 26 and attempts to pass over the stairwell threshold 28 to the landing 30. In this example there are three rows of apertures 62, though this is not required. The apertures 62 extend through the threshold plate 56, as shown by aperture 63, which is partially in fragment.

The threshold plate 56 includes a second portion in this example a second angled portion 64. The second angled portion 64 extends upwards from the base 58 from right to left, from the perspective of FIG. 3. The second angled portion 64 at least partially faces in the direction of the landing 30. The second angled portion 64 has a plurality of apertures 66, in this example, also in rows of three. The apertures 66 extend through the threshold plate 56 as shown by aperture 67.

The threshold plate 56 may include a middle portion 68 interposed between the first angled portion 60 and the second angled portion 64. In this example the middle portion 68 is rectangular in cross-section. Thus the threshold plate 56 is, in this example, isosceles trapezoid shaped in cross-section, as best shown in FIG. 3.

The stairwell drainage assembly 29 includes a trough 72, as best shown in FIG. 3. The trough 72 extends along the first stairwell threshold 28. The trough 72 extends downwards from floor 33, from the perspective of FIG. 3. In this example the trough 72 has a rectangular cross section, though this is not required, with a bottom 76 and a pair of spaced-apart side walls as indicated by side wall 74. The threshold plate 56 is positioned such that apertures 62 are aligned and in communication with the trough 72. In this example the threshold plate 56, via the first angled portion 60, covers the trough 72. In this example the apertures 62 are directly overtop of the trough 72.

In the preferred embodiment shown in FIGS. 2 and 3, the stairwell drainage assembly 29 also includes an additional trough 86. The additional trough 86 extends along the first stairwell threshold 28. The additional trough 86 extends downwards from the perspective of FIG. 3 and relative to landing 30. The additional trough 86 has a rectangular cross section with a bottom 90 and a pair of spaced-apart side walls as indicated by side wall 88. The threshold plate 56 is positioned such that apertures 66 are aligned and in communication with the additional trough 86. In this example the threshold plate 56, via the second angled portion 64, covers the additional trough 86. In this example the apertures 66 are directly overtop of the additional trough 86. Referring to FIG. 2, the seal 59 is positioned on the base 58 of the threshold plate 56 between trough 72 and additional trough 86.

In one preferred embodiment the trough 72 and the additional trough 86 are formed as parts of the concrete structure 24 of the building 20, as shown in FIG. 3. Alternatively the trough 72 and the additional trough 86 may, for example, be formed as part of a modified door sill.

The stairwell drainage assembly 29 includes a stairwell drain 78. The stairwell drain 78 in this example is in the form of a pipe. The stairwell drain 78 connects to the trough 72 via opening 80. The stairwell drain 78 is thus in fluid communication with the trough 72.

The stairwell drainage assembly 29 includes an additional stairwell drain 92. The additional stairwell drain 92 in this example is also in the form of a pipe. The additional stairwell drain 92 connects to the trough 86 via opening 94. The additional stairwell drain 92 is thus in fluid communication with the additional trough 86.

In one preferred embodiment the stairwell drain 78 and the additional stairwell drain 92 are disposed within the concrete structure 24 of the second floor 22. Referring back to FIG. 1, the concrete structure for the landing 30 is partially removed to reveal the stairwell drain 78 and the additional stairwell drain 92.

Figure 4:
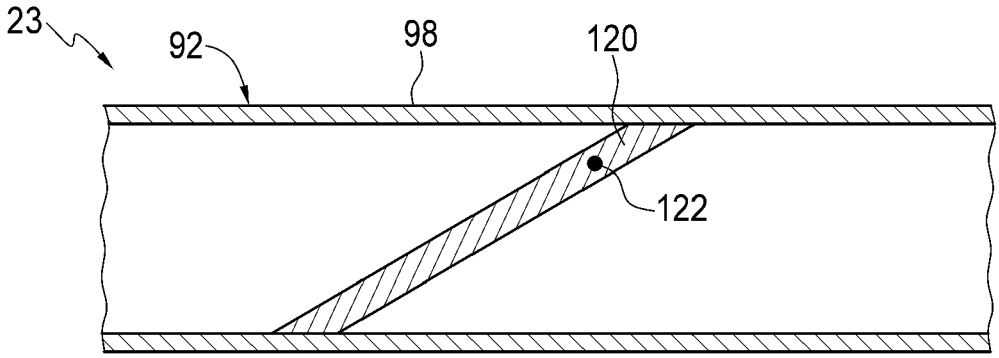
FIG. 4 is a fragmentary, cross-sectional view of a stairwell drain, according to the embodiment of the floor drainage system shown in FIG. 1, with a damper pivotally mounted to the stairwell drain, the damper being disposed in a closed position.
Figure 5:
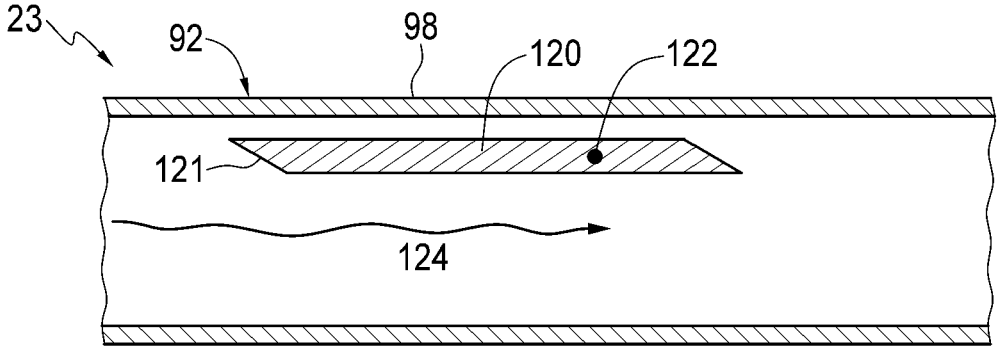
FIG. 5 is a fragmentary, cross-sectional view of the stairwell drain shown in FIG. 4, with the damper disposed in an open position.

Referring to FIGS. 4 and 5, this shows a fragmentary section 98 of the additional stairwell drain 92. The first stairwell drainage assembly is not shown in these Figures but would be to the left, from the perspective of FIGS. 4 and 5, though this is not required. A damper 120 is disposed within and pivotally mounted to the additional stairwell drain 92 via in this example pivot rod 122. The damper 120 is disposed to float in water by, for example, being made of a material that floats, such as buoyant plastic. FIG. 4 shows the damper 120 in a closed position. Air pressure normally holds the damper 120 in the closed position. The damper 120 is shaped to inhibit fluid communication along the stairwell drain 92 when the damper is in the closed position. This is advantageous for maintaining air pressure, such as maintaining independent stairwell plenums. The damper 120 is also advantageous for inhibiting smoke from other floors/regions from passing through the additional stairwell drain 92 to various other floors/suites.

When water collected in the trough of the first stairwell drainage assembly associated with the additional stairwell drain 92 passes through the additional stairwell drain 92, the water causes the damper 120 to float. This is shown in FIG. 5. End 121 of the damper 120 rises up, from the perspective of FIG. 5. The damper 120 is thereby in an open position and allows fluid communication along the additional stairwell drain 92. This is illustrated by way of arrow 124 which represents water flow.

In another embodiment, a similar damper assembly may be provided for the stairwell drain 78 shown in FIG. 1. The damper assembly for the stairwell drain 78 according to this other embodiment has similar parts and operates in a like manner and therefore will not be described further.

Referring back to FIG. 1, the stairwell drain 78 and the additional stairwell drain 92 in this example extend to the stairwell divider wall 42. A first stairwell pipe 126 is connected to and in this example is at least partially embedded within the stairwell divider wall 42. An end view of the first stairwell pipe 126 is shown in FIG. 1. The first stairwell pipe 126 extends vertically through the various floors of the building 20 in parallel with the stairwell divider wall 42. The first stairwell pipe 126 has an interior 127.

A divider 131 is disposed within the interior 127 of the first stairwell pipe 126 and extends along the first stairwell pipe 126. The divider 131 is shaped to split the first stairwell pipe 126 longitudinally into a first part 128 and a second part 130. In this example the divider 131 splits pipe 126 in two, with the first part 128 and the second part 130 each having a cross-section that is semi-circular. The stairwell drain 78 is in fluid communication with the first part 128 of the first stairwell pipe 126. The first part 128 of the first stairwell pipe 126 may thus be said to be part of the stairwell drain 78. The additional stairwell drain 92 is in fluid communication with the second part 130 of the first stairwell pipe 126. The second part 130 of the first stairwell pipe 126 may thus be said to be part of the additional stairwell drain 92.

The second stairwell drainage assembly 39 is located at least in part adjacent to the second stairwell threshold 38. The second stairwell drainage assembly 39 includes trough 129 and additional trough 133. The second stairwell drainage assembly 39 in a preferred embodiment also includes a threshold plate (not shown) as shown in FIG. 2. The threshold plate of the second stairwell drainage assembly 39 is similar in its features and function to threshold plate 56 and therefore will not be described further.

The second stair drainage assembly 39 includes stairwell drain 132 and additional stairwell drain 134 which are connected to trough 129 and additional trough 133, respectively. According to a preferred embodiment, additional stairwell drain 134 includes a damper and related assembly similar to that shown in FIGS. 4 and 5. The damper inhibits passages of fluids, such as air or smoke etc, along the drain 134 when it is not draining water and also aids in maintaining independent stairwell plenums. In another variation, the stairwell drain 132 may also include a damper similar to that shown in FIGS. 4 and 5. The second stair drainage assembly 39 is a mirror of the first stair drainage assembly 29 in terms of parts and function and therefore will not be described in further detail.

Stairwell drain 132 and additional stairwell drain 134 extend to the stairwell divider wall 42. A second stairwell pipe 136 is connected to and in this example at least partially embedded within the stairwell divider wall 42. The stairwell pipe 136 extends vertically across the various floors of the building 20 in parallel with the stairwell divider wall 42. The stairwell pipe 136 has an interior 137.

A divider 141 is disposed within the interior 137 of the stairwell pipe 136. The divider 141 extends longitudinally within the second stairwell pipe 136. The divider 141 is shaped to split the stairwell pipe 136 into a first part 138 and a second part 140, each part in this example having a cross-section that is semi-circular. The stairwell drain 132 is in fluid communication with the first part 138 of the stairwell pipe 136. The first part 138 of the second stairwell pipe 136 may thus be said to be part of the stairwell drain 132.

The additional stairwell drain 134 is in fluid communication with the second part 140 of the second stairwell pipe 136. The second part 140 of the second stairwell pipe 136 may thus be said to be part of the additional stairwell drain 134.

Figure 6:
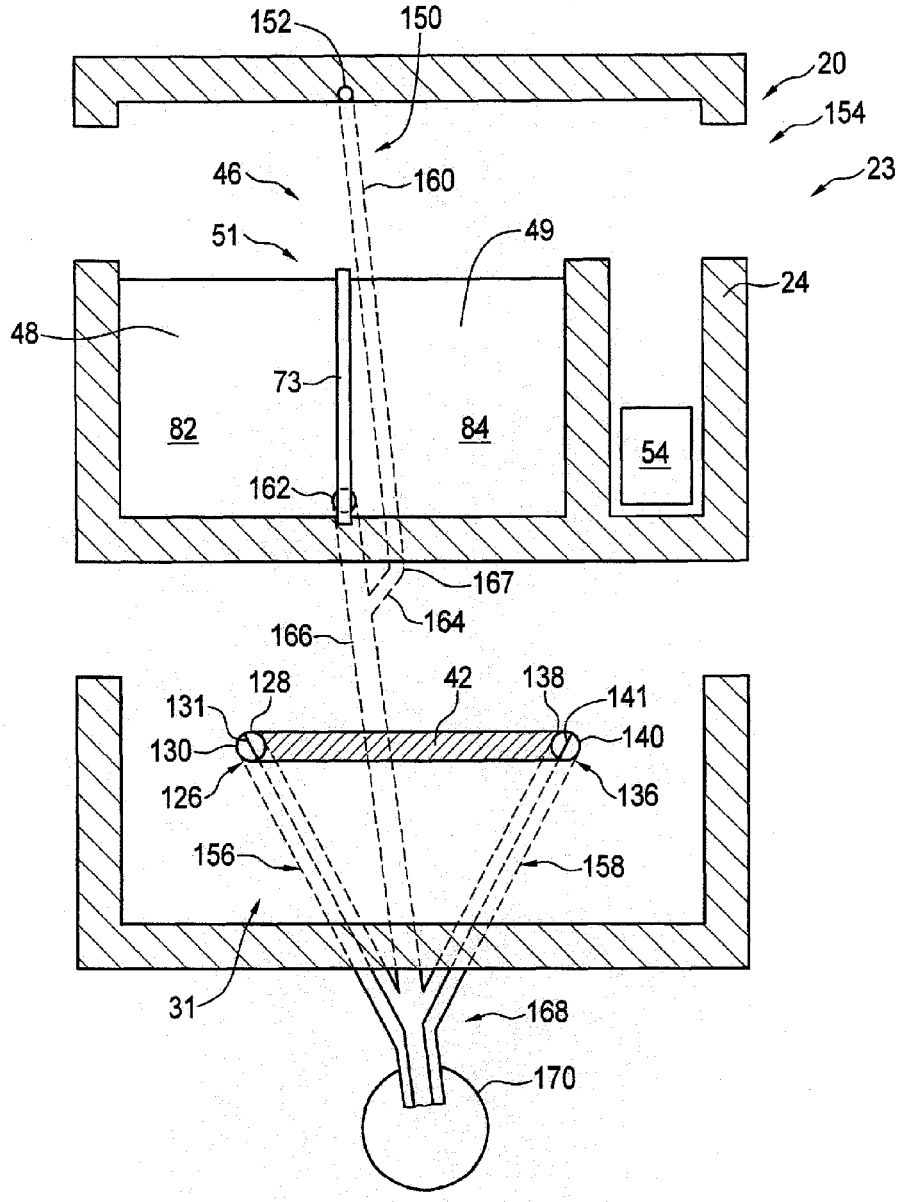
FIG. 6 is a fragmentary, cross-sectional top view of a first floor of the building shown in FIG. 1, the building including a catch basin and features of the floor drainage system according to the embodiment of FIG. 1 shown partially in hidden lines.

Referring now to FIG. 6, this shows a lower floor, in this example a basement floor 154. The basement floor 154 is situated below the second floor 22 of FIG. 1. The basement floor 154 in this example includes a catch basin 170. As seen in FIGS. 2 and 6, the stairwell drain 78 is thus interposed between trough 72 and catch basin 170, and the additional stairwell drain 92 is thus interposed between trough 86 and the catch basin. Referring back to FIG. 6, the first stairwell pipe 126 includes a section 156 that is shown in hidden lines because, in this example, section 156 is embedded within the concrete structure 24 of the basement floor 154. Similarly the second stairwell pipe 136 includes a section 158, shown in hidden lines, that is embedded within the concrete structure 24 of the basement floor 154.

Figure 8:
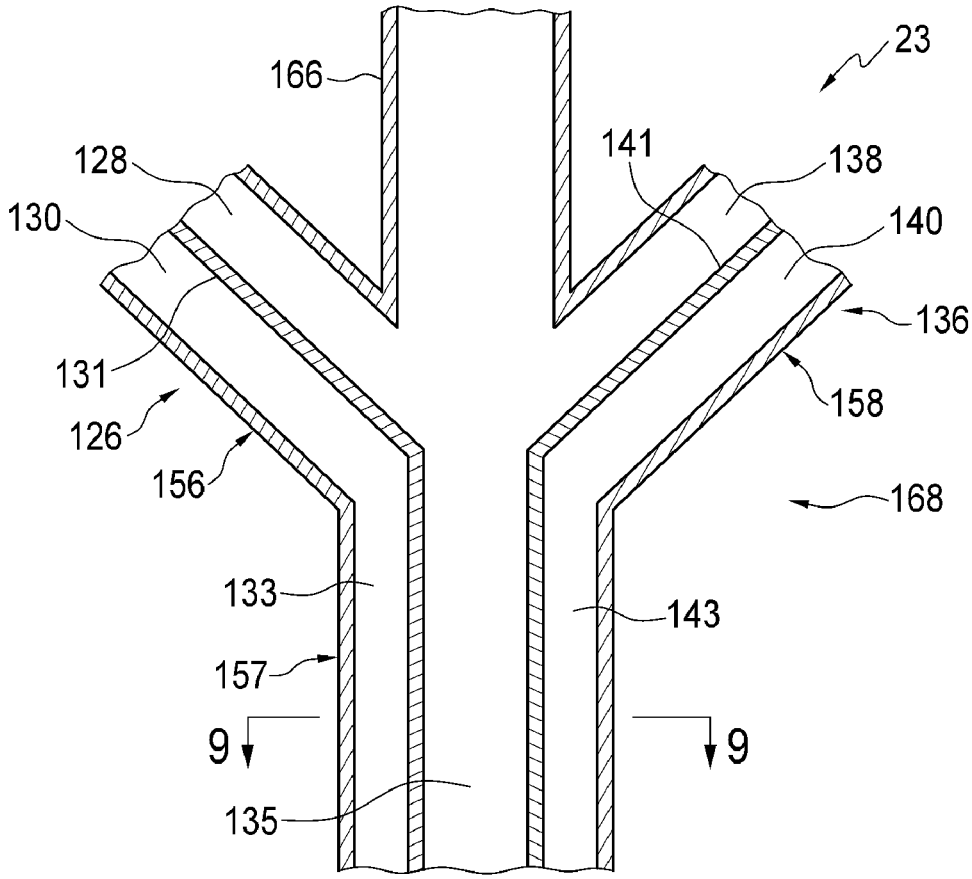
FIG. 8 is a fragmentary, cross-sectional view of a plurality of conduits of the floor drainage system according to the embodiment of FIG. 1 meeting at a junction.

The floor drainage system 23 in this example includes a junction 168 that connects together the first stairwell pipe 126 and the second stairwell pipe 136, as best shown in FIG. 8. The junction 168 connects the first part 128 of the first stairwell pipe 126 to the first part 138 of the second stairwell pipe 136. The first part 128 of the first stairwell pipe 126 is thus in communication with the first part 138 of the second stairwell pipe 136. The second part 130 of the first stairwell pipe 126 and the second part 140 of the second stairwell pipe 136 remain separate from each other, in this example. Referring back to FIG. 6, the first stairwell pipe 126 is thus in fluid communication with the catch basin 170 via its section 156 and junction 168. The second stairwell pipe 136 is thus in fluid communication with the catch basin 170 via its section 158 and junction 168.

Figure 7:
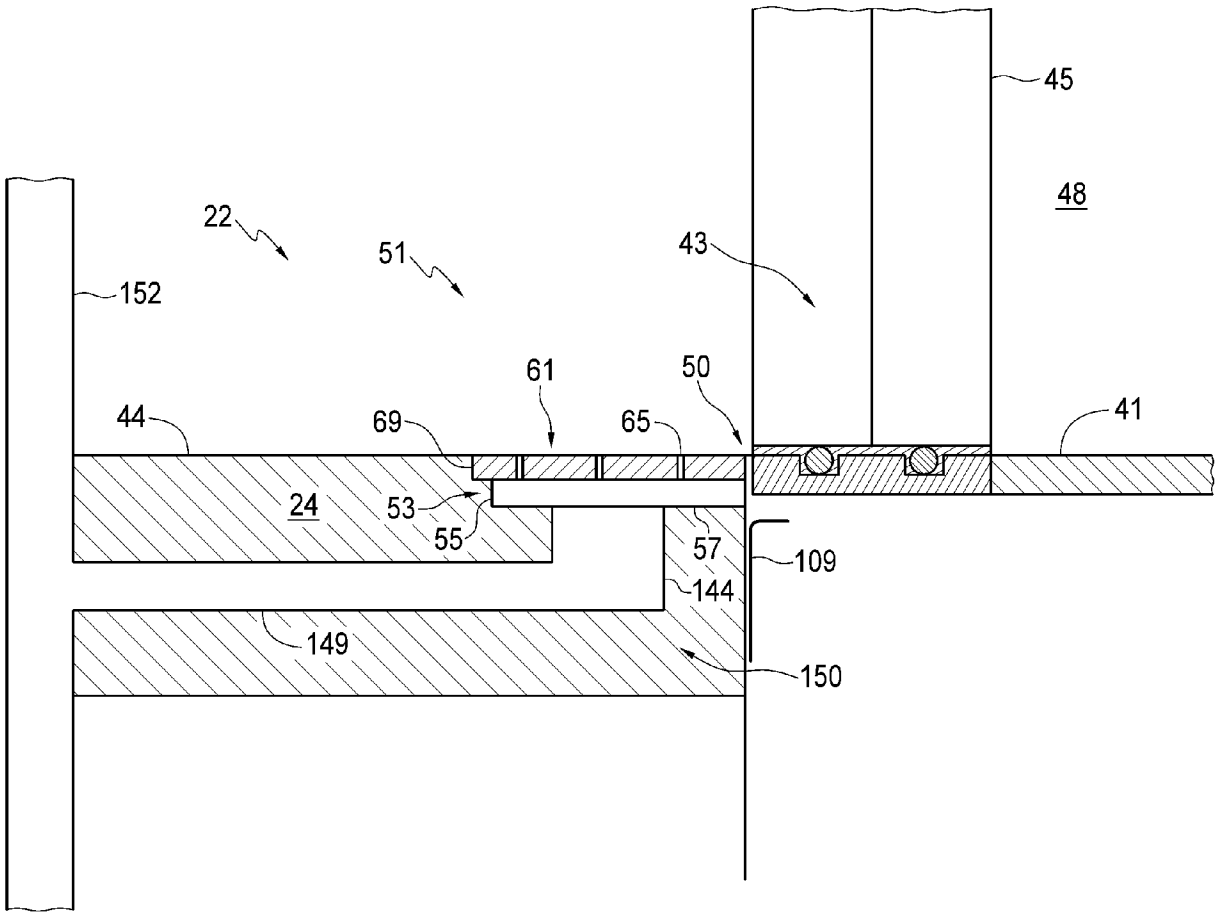
FIG. 7 is a cross-sectional end view of a threshold plate extending adjacent to a hoistway threshold and a fragmentary end view of features of a hoistway trough.

Referring back to FIG. 1, the hoistway drainage assembly 51 is located at least in part adjacent to the hoistway threshold 43. Referring to FIG. 7, elevator sliding doors 45 extend along the hoistway threshold 43. As seen in FIG. 7, the hoistway threshold 43 is interposed between an elevator floor 41 and the elevator lobby 44. The hoistway threshold 43 has an end 50 facing the elevator lobby 44.

The hoistway drainage assembly 51 includes a hoistway trough 53 extending adjacent to and spaced-apart from the hoistway threshold 43. As seen in FIG. 1, portions 142 and 146 of trough 53 extends along the entire length of the hoistways 48 and 49. Referring to FIG. 7, in this example the hoistway trough 53 abuts end 50. The hoistway trough 53 extends downwards from the perspective of FIG. 7 and relative to the lobby 44. The hoistway trough 53 has a rectangular cross section with a bottom 57 and a pair of spaced-apart side walls as indicated by side wall 55. The trough 53 is similar in shape to one of the troughs shown in FIG. 2.

The hoistway drainage assembly 51 in a preferred embodiment also includes a threshold plate 61. The threshold plate 61 in this example also abuts end 50. The threshold plate 61 is not shown in, but is a part of, the system of FIG. 1. The threshold plate 61 extends across and along the hoistway trough 53. The threshold plate 61 in this example is rectangular in cross-section. The threshold plate 61 is disposed within recess 69 that extends downwards from the perspective of FIG. 7 and relative to the lobby 44. The threshold plate 61 is positioned to be flush, and in this example in parallel, with the elevator lobby 44.

In this example the threshold plate 61 has three rows of apertures 65. The arrangement of the apertures 65 is similar to the aperture arrangement of the threshold plate 56 shown in FIG. 2. The apertures 65 extend through the threshold plate 61. The apertures 65 are sufficiently small to inhibit, for example, high-heels from getting stuck in the apertures 65. The threshold plate 61 is positioned such that apertures 65 are aligned and in communication with the trough 53. In this example the apertures 65 are directly overtop of the hoistway trough 53.

The hoistway drainage assembly 51 also includes a drain for draining the trough 53 and, in this example the drain is referred to collectively as a hoistway trough drain 150. The hoistway trough drain 150 is in fluid communication with the hoistway trough 53. The hoistway trough drain 150 in this example includes a first conduit 144, a second conduit 148 and a conduit 149, as shown in FIG. 1, which is partially broken away to reveal the conduits 144, 148 and 149. Conduits 144, 148 and 149 extend at least in part approximately in parallel with the elevator lobby 44. Conduits 144, 148 and 149 are disposed within the concrete structure 24 and thus remain hidden. Conduits 144, 148 and 149 are only revealed in FIG. 1 via the partially broken away elevator lobby 44 for ease of explanation.

The first conduit 144 and the second conduit 148 connect with the hoistway trough 53. In this example the first conduit 144 connects to portion 142 of the hoistway trough 53 which is adjacent to the first hoistway 48. The second conduit 148 connects to portion 146 of the hoistway trough 53 which is adjacent to the second hoistway 49.

Referring back to FIG. 7, the hoistway drainage assembly 51 may abut a grout plate 109.

The hoistway trough drain 150 includes conduit 152. Referring to FIG. 1, the hoistway trough drain 150 in this example extends to wall 151 which faces the hoistways 48 and 49. As best shown in FIG. 1, conduit 152 is at least partially embedded within the wall 151. An end 153 of the conduit 152 of the hoistway trough drain 150 is shown in FIG. 1. The conduit 152 of the hoistway trough drain 150 extends vertically down through floors of the building 20 in parallel with the wall 151.

In one embodiment, the hoistway trough drain 150 may have a damper assembly similar to that shown in FIGS. 4 and 5 for the stairwell drain 92, though this is not required. The damper assembly for the hoistway trough drain 150 has similar parts and operates in a like manner and therefore will not be described further.

Referring to FIG. 6, the hoistway trough drain 150 further includes conduit 160, bend 167, conduit 164, and conduit 166, which are shown in hidden lines because they are, in this preferred embodiment, disposed within concrete structure 24 of the basement floor 154. The hoistway trough drain 150 is in fluid communication with the catch basin 170 via conduit 152, conduit 160, conduit 164, conduit 166 and junction 168.

Building codes typically require that a building have a hoistway drain. The hoistway drainage assembly 51 therefore, in this preferred embodiment, further includes a hoistway drain 162 for capturing and draining water that may reach pit 82 of the first hoistway 48 and/or pit 84 of the second hoistway 49. The hoistway drain 162, in this example, is disposed approximately 8 to 10 feet below an I-beam 73. The I-beam 73 is approximately level with the basement floor 154. The hoistway drain 162 is in communication with both pit 82 and pit 84. The hoistway drain 162 is in fluid communication with the catch basin 170 via conduit 166 and junction 168.

Water from the hoistway trough drain 150 and water from the hoistway drain 162 may mix together at conduit 166. Referring to FIG. 8, junction 168 connects conduit 166 with both the first part 128 of the first stairwell pipe 126 and the first part 138 of the second stairwell pipe 136. Conduit 166 is thus connected to and in fluid communication with both the first part 128 of the first stairwell pipe 126 and the first part 138 of the second stairwell pipe 136.

Figure 9:
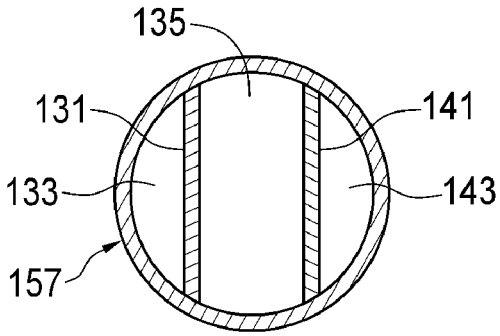
FIG. 9 is a cross-sectional end view along lines 9-9 but showing the entire cross-section of an outer conduit extending from the junction of FIG. 8.

As seen in FIG. 8, junction 168 includes an outer conduit 157. Divider 131 and divider 141 extend within the outer conduit 157. Referring to FIGS. 8 and 9, the outer conduit 157 thus comprises: a partially circular portion 133 through which water from the second part 130 of the first stairwell pipe 126 may pass; a central portion 135 through which water from the first part 128 of the first stairwell pipe 126, water from the first part 138 of the second stairwell pipe 136 and water from the conduit 166 may pass; and a partially circular portion 143 through which water from the second part 140 of the second stairwell pipe 136 may pass.

Figure 10:
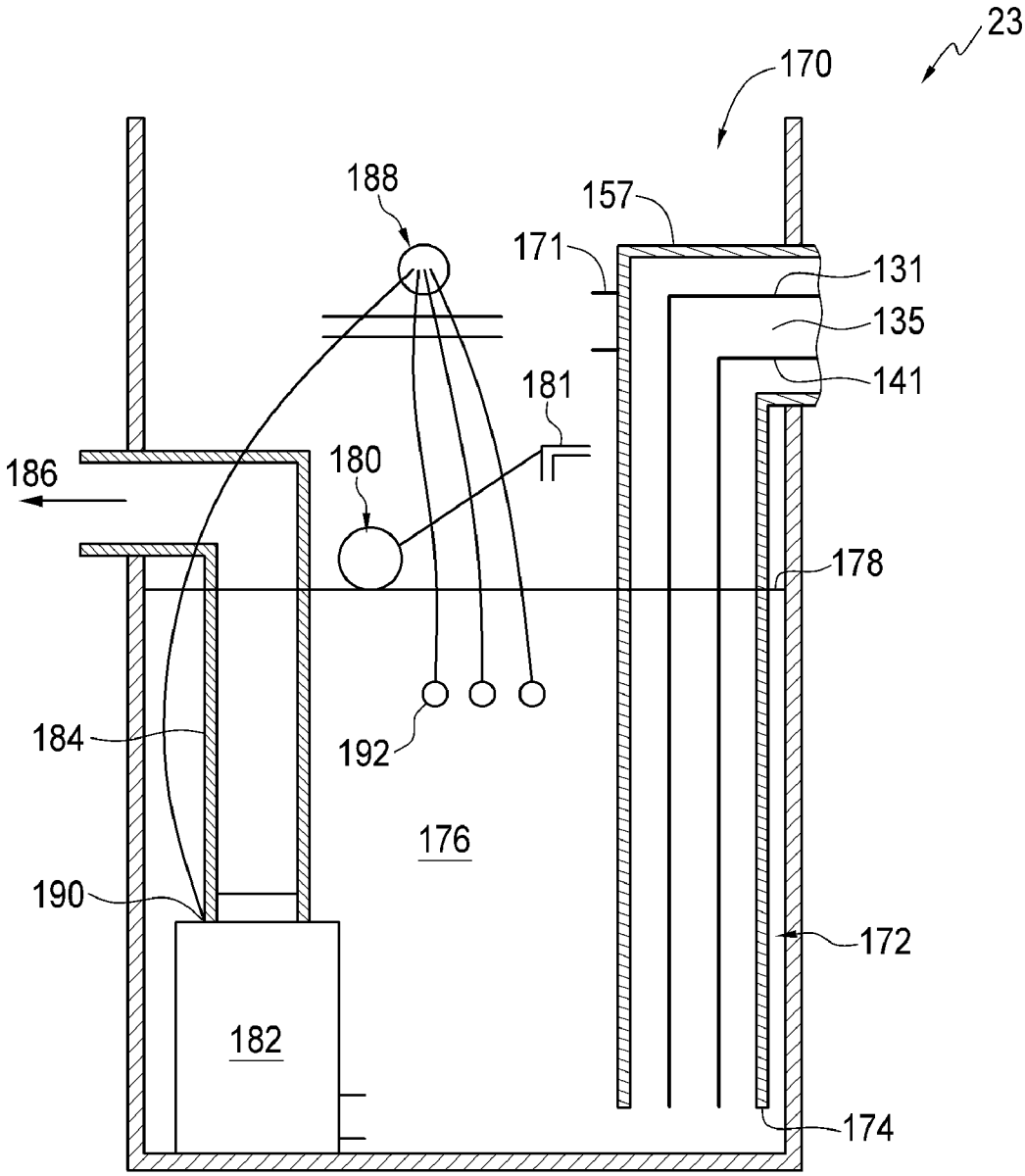
FIG. 10 is a cross-sectional view of the catch basin shown in FIG. 6 and features of the floor drainage system according to the embodiment of FIG. 1.

Referring to FIG. 10, the central portion 135 of the outer conduit 157 is vented via vent 171. The vent 171 is operatively connected to and in fluid communication with the central portion 135 of the conduit 157. The vent 171 inhibits siphoning or gurgling from occurring.

FIG. 10 also shows the catch basin 170 in greater detail. The catch basin 170 is filled with fluid in this example water 176. A variable waterline 178 is formed by the water 176. The outer conduit 157 extends to a portion 172 that is situated below the waterline 178, from the perspective of FIG. 10. The outer conduit 157 has an opening 174. The outer conduit 157 is in communication with the catch basin 170 and water 176 via the opening 174. The outer conduit 157 is so disposed as to inhibit air or air pressure from escaping from, for example, the second floor 22 shown in FIG. 1. Put another way, the positioning of the outer conduit 157 causes the conduit 157 to function as an air seal while allowing drainage.

The catch basin 170 includes a pump 182 with a conduit 184 extending therefrom. The pump 182 removes water from the catch basin 170 via the conduit 184, as indicated by arrow 186. In a preferred embodiment, the pump 182 is operatively connected to and in fluid communication with a sanitary facility, though this is not required. The pump 182 may operatively connect to some other reservoir or region for holding water and/or disposing accumulated water away from the building.

The catch basin 170 in this example includes controls 188 with sensors 190, 192 for controlling the pump 182 and monitoring water levels within the catch basin 170. The catch basin 170 also in this example includes a float valve assembly 180, 181 for monitoring water levels. The float valve assembly 180, 181 maintains the catch basin system at a constant minimum water level. Catch basins 170 per se are well known to those skilled in the art and therefore the above features will not be described further.

In operation and referring to FIG. 1, water from the first suite 27 that reaches the first stairwell threshold 28 trickles down apertures 62 of the first angled portion 60 of the threshold plate 56 to the trough 72. The water is thus at least partially captured by trough 72. Referring to FIG. 2, the threshold plate 56 via its first angled portion 60, because it is angled, also acts to contain water spillage within the suite 27 and inhibits water from passing to the landing 30. The first stairwell drainage assembly 29 with its trough 72 and threshold plate 56 therefore provides a synergistic solution to the problems of water flooding and consequently the spread of water damage to other floors/suites. Water from the first suite 27 may be further captured by additional trough 86 via water trickling down apertures 66 of the second angled portion 64 of the threshold plate 56.

The captured water then passes into the stairwell drain 78 and additional stairwell drain 92, if employed, in which case the damper 120 is caused to float, as a result of the water and the damper's buoyant material. The damper 120 thus moves to the open position as shown in FIG. 5.

Referring back to FIG. 1, the water thus may pass through the first stairwell drain pipe 126 and into the catch basin 170, as shown in FIG. 6. Referring again to FIG. 1, the first stairwell drainage assembly 29 thus acts to inhibit water flooding the suite 27 (or room 26) from passing to other floors and/or other suites such as the additional suite 37 (or room 36).

Referring to FIG. 10, because the outer conduit 157 is in communication with the catch basin 170 below the waterline 178, isolation of the stairwell plenum is maintained. Also, the outer conduit 157 is so positioned to inhibit passing of air or smoke from the basement floor through the outer conduit 157 to other areas of the building.

Referring to FIG. 2, in a like manner trough 86 acts to capture water from the stairwell that reaches landing 30 from entering the room 26 and thereby acts to inhibit water damage from spreading. Also, there is synergy when this is combined with the second angled portion 64 of the threshold plate 56 which acts to contain water flooding the stairwell and landing 30. The water captured by trough 86 passes through the various conduits in a manner similar to that described above.

The second stairwell drainage assembly 39 operates in a similar manner to that described above and therefore will not be described further. Providing drainage assemblies at every stairwell threshold results in a more comprehensive capturing of water flooding and more comprehensive containment of water. The floor drainage system 23 thus acts to inhibit the spread of water between floors. The floor drainage system 23 is thus very useful for controlling and/or mitigating water damage otherwise arising from situations such as where: a pipe bursts; fire sprinkles are activated, inadvertently or otherwise; or a water tap, for example a water tap for a bath tub is left running and overflows.

The hoistway drainage assembly 51 also operates in a similar manner to as described above and therefore will not be described. The feature of providing hoistway drainage assemblies adjacent to every hoistway threshold results in an even more comprehensive system for capturing of unwanted water and an even more comprehensive containment of unwanted water.

In a completed building such as a high rise, the only available floor to floor water courses for large spills may be through the pressurized stairwell and the hoistway openings (hoistway thresholds). The floor drainage system provides the advantage of offering redundant drainage that comprehensively targets drainage for these regions without comprising stairwell pressure.

The floor drainage system as herein disclosed may thus advantageously lead to a reduction in the number of water damage problems and claims. This in turn may lead to lower building insurance premiums. Moreover, by reducing the risk of catastrophic flooding and water damage, the floor drainage system as herein disclosed may provide a homebuyer with an increased peace of mind and sense of security in the safety, durability and resilience of their home and thus investment.

Figure 11:
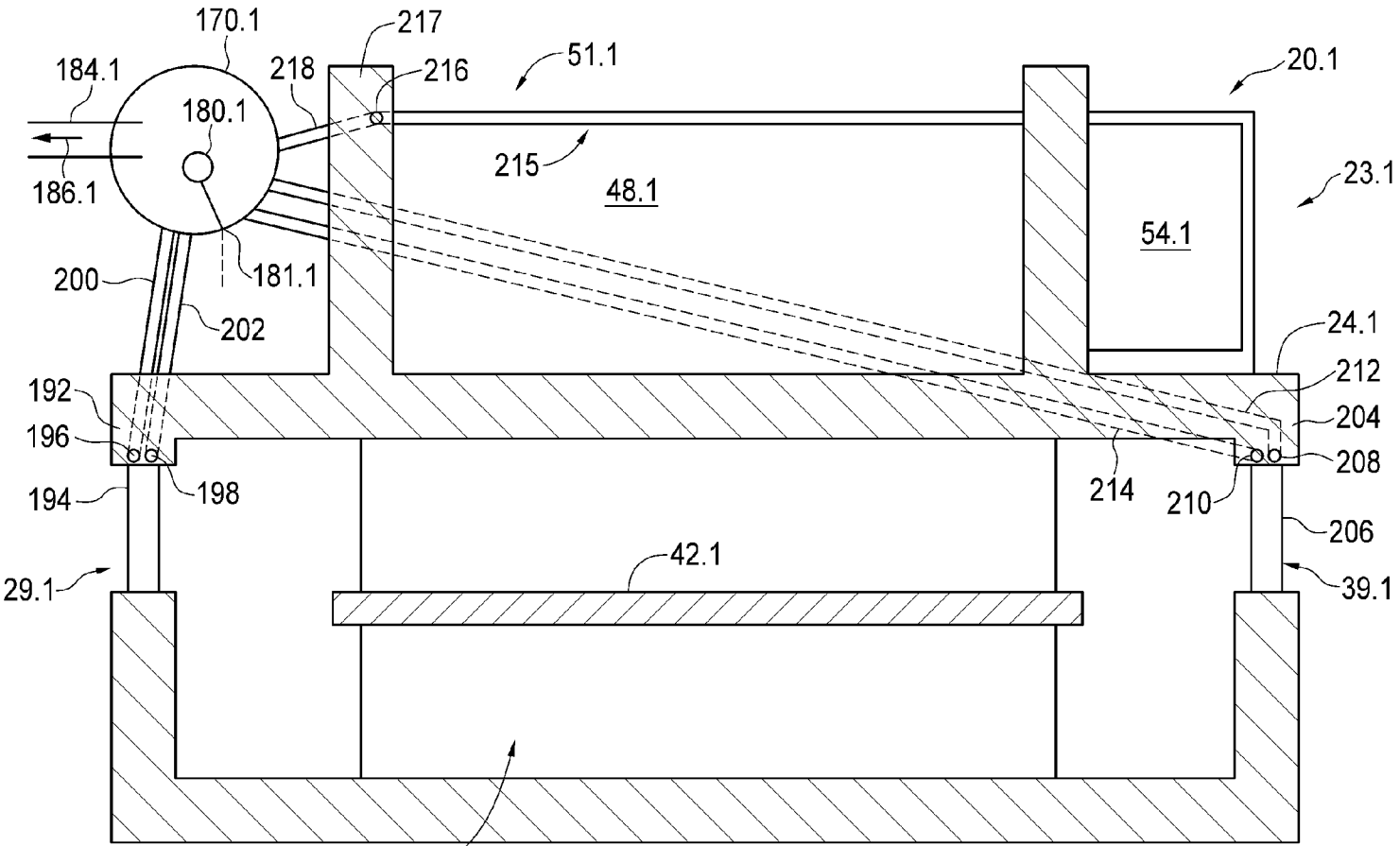
FIG. 11 is a fragmentary, cross-sectional top view similar to FIG. 6 of a first floor of a building according to another embodiment and features of a floor drainage system according to another embodiment, with some features of the floor drainage system being shown partially in hidden lines.

FIG. 11 is an illustration of a building 20.1 and a floor drainage system 23.1 according to another embodiment. Like parts have like numbers and function with the addition of "0.1". System 23.1 thus, for example, includes stairwell 31.1, stairwell divider wall 42.1, first hoistway 48.1, float valve assembly 180.1 and 181.1, conduit 184.1, and arrow 186.1, the latter indicating removal of water from the catch basin 170.1. In this embodiment, the first stairwell drainage assembly 29.1 has a stairwell drain 196 and an additional stairwell drain 198 embedded within a section 192 of concrete structure 24.1 that is adjacent to a stairwell threshold 194. Drains 196 and 198 are in fluid communication with the catch basin 170.1 via conduits 200 and 202.

The second stairwell drainage assembly 39.1 has a stairwell drain 208 and an additional stairwell drain 210 embedded within a section 204 of the concrete structure 24 that is adjacent to the stairwell threshold 206. Drains 208 and 210 are in fluid communication with the catch basin 170.1 via conduits 212 and 214. The hoistway drainage assembly 51.1 has a hoistway trough drain 216 embedded within a section 217 of the concrete structure 24 that is adjacent to the hoistway threshold 215. Drain 216 is in fluid communication with the catch basin 170.1 via conduit 218. The embodiment shown in FIG. 11 may provide the advantage of a floor drainage system that requires fewer parts, such as less piping. This may result in a savings in parts cost and labour installation costs.

Figure 12:
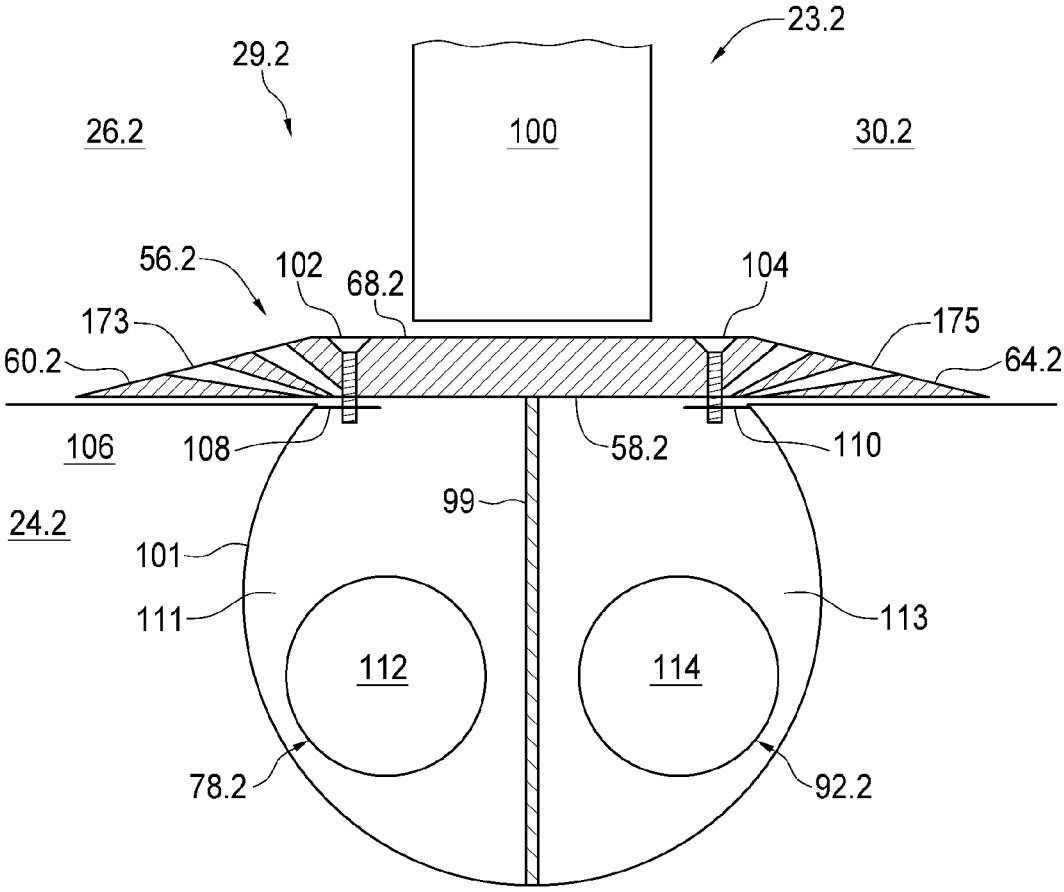
FIG. 12 is a cross-sectional end view similar to FIG. 3 of a threshold plate according to a further embodiment and an end view of features of the floor drainage system according to the further embodiment.

FIG. 12 is an illustration of a floor drainage system 23.2 according to another embodiment. Like parts have like numbers as the embodiment of FIGS. 1 to 10 with the addition of "0.2" and are functionally similar. System 23.2 thus, for example, includes room 26.2, first stairwell drainage assembly 29.2, threshold plate 56.2, base 58.2 of threshold plate 56.2, first angled portion 60.2 of threshold plate 56.2, second angled portion 64.2 of threshold plate 56.2, and middle portion 68.2 of threshold plate 56.2. Instead of two troughs, there is provided one trough 101. The trough 101 has a circular shape in cross-section. The trough 101 is separated in two parts via trough longitudinal divider 99. The trough 101 thus has a first section 111 and a second section 113. Stairwell drain 78.2 is in fluid communication with the first section 111 via opening 112. Additional stairwell drain 92.2 is in fluid communication with the second section 113 via opening 114.

The trough 101 is formed within section 106 of the concrete structure 24.2. In one preferred embodiment, the trough 101 is cast in place. Flanges 108 and 110 extend from section 106 and align with the threshold plate 56.2. The threshold plate 56.2 is disposed below a door 100. The threshold plate 56.2 is connectable to the flanges 108 and 110 via screws 102 and 104. The threshold plate 56.2 has apertures 173 and 175 that are angled and slightly tapered to reach trough 101.

Figure 13:
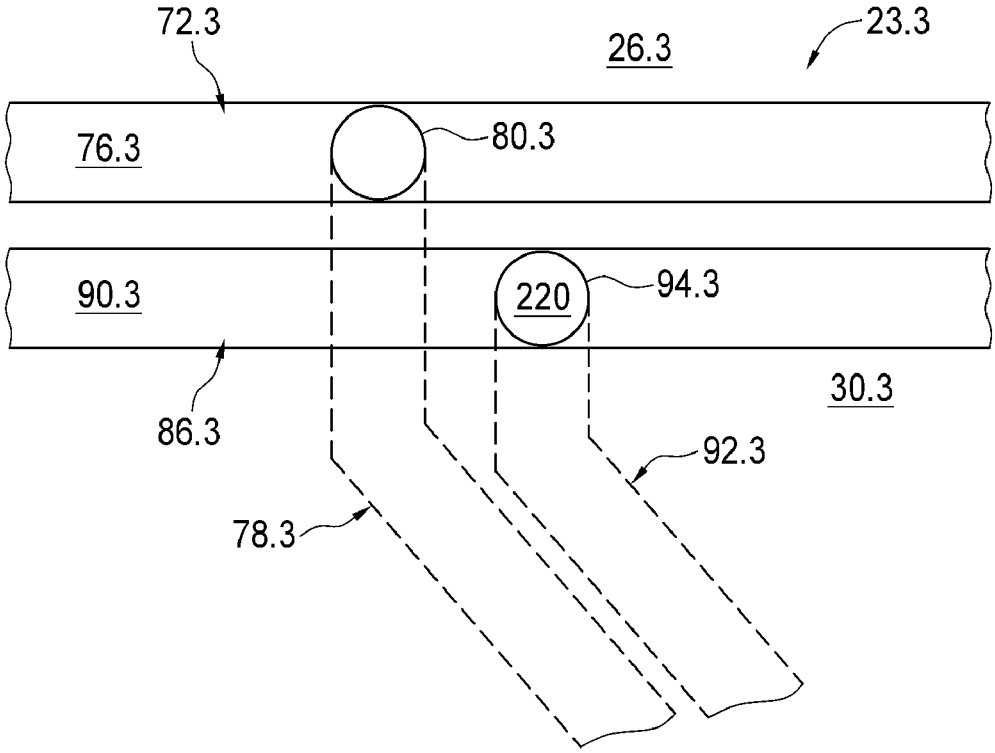
FIG. 13 is a fragmentary, top plan view of two troughs connected to two drains according to yet a further embodiment of the floor drainage system, with water-dissolvable wafers interposed between the troughs and drains.

FIG. 13 is an illustration of a floor drainage system 23.3 according to another embodiment. Like parts have like numbers and function with the addition of "0.3". System 23.3 thus, for example, includes trough 72.3, bottom 76.3 of trough 72.3, additional trough 86.3 and bottom 90.3 of additional trough 86.3. Trough 72.3 and additional trough 86.3 are shown partially in fragment. A salt wafer 220 is shaped to block opening 94.3. The salt wafer 220 is water soluble. The use of the salt wafer 220 may thus remove the need for a damper 120 as shown in FIGS. 4 and 5. The salt wafer 220 is shaped to inhibit fluid communication between the room 26.3 (or landing 30.3) and the additional stairwell drain 92.3 until water floods troughs 86.3. Drains 78.3 and 92.3 are disposed within the concrete structure and are therefore partially shown in hidden lines. Once water enters the trough 86.3, the salt wafer 220 dissolves, thereby allowing water to pass through to the drain 92.3. In a further variation, a second salt wafer is used to block opening 80.3 and inhibit communication between drain 78.3 and the room 26.3 (or landing 30.3) when there is no flooding. A similar salt wafer may be used for the hoistway drainage assembly.

Those skilled in the art will appreciate that many further variations are possible within the scope of the inventions herein described. For example the embodiments shown in FIGS. 11 to 13 may be combined in part or in whole, in a variety of forms, with each other and/or with the embodiment shown in FIGS. 1 to 10.

In a variation, the system can include a further drainage assembly installed underneath or adjacent to door 47 shown in FIG. 1. In FIG. 1, instead of a stairwell 31, the connection room may be a hallway.

Instead of or in addition to drainage assemblies for stairwells, drainage assemblies as herein described may be installed at the entry door threshold of every suite on every floor of a building. Put another way, the system may include drainage assemblies at the entrances to some or all suites of a building. For example, in some buildings there may be a hallway linking the suites together with a drainage assembly at every suite door entrance. The stairwell may be linked to and in fluid communication with the hallway. The system may further include stairwell drainage assemblies interposed between the hallways and the stairwells.

Such configurations may result in an even more comprehensive system for capturing and containing unwanted water.

The troughs, such as trough 72 and trough 86, may include a waterproof lining to inhibit water from, for example, escaping into the floor foundation.

While the floor drainage assembly 29 shown in FIGS. 2 and 3 has two troughs 72 and 86, in a variation only one trough need be used, for example either trough 72 or trough 86. If the system only provides trough 72, a salt wafer or damper could also be added to its drain 78.

The hoistway threshold plate could be omitted from the hoistway drainage assembly. In one variation, the threshold plate could be made as part of the concrete structure. In another variation, the floor drainage system uses only troughs and does not include threshold plates.

A check valve may be used instead of salt wafers. Alternatively a water-soluble material other than salt wafers may be used in place of wafers to the same effect. Instead of piping 126, 136 that is split with a divider, two separate conduits may perform the same function. The trough may take the form of one or more slit trenches.

Those skilled in the art will appreciate that a catch basin, according to one aspect, is not required by the floor drainage system. For example, the floor drainage system can have the drains 78, 92, 132, 134, 150 and 162 operatively extending elsewhere for depositing water away from the building.

If the building had a ramp, a slide, a ladder or other means through which water could pass from one floor to another, those skilled in the art will appreciate that floor drainage assemblies as herein described may be further disposed at the threshold of such passageways between floors. Floor drainage assemblies can be disposed at the threshold of the vent duct 54 instead using adequate flanging for the vent duct and vent duct waterproofing.

The floor drainage system as herein disclosed may be used for water control during construction. This may, for example, be useful for directing water needed during the construction process. Alternatively the system may be useful in providing a way to inhibit flooding that may otherwise occur during the various stages of construction of a building. As a result, the system may reduce the hours needed for a mason to build, for example, dams. Also this system may result in significant savings due to, for example, the reduced need for mortar. By reducing the hours a mason is required, hoist time that would otherwise be used for labourers, masons and related parts may be reduced. In short, the floor drainage system as herein disclosed may result in great savings to a builder by reducing the amount of water damage and water control expenditure.

While the floor drainage system as herein disclosed is directed to use in a building, a similar system may be used, for example, in a marine application. This would provide the advantage of, for example, further protecting wiring and wire rooms from water damage.

It will be understood by someone skilled in the art that many of the details provided above are by way of example only and are not intended to limit the scope of the invention which is to be determined with reference to the following claims.

What is claimed is:

1. A building having a first floor, a second floor disposed above the first floor, the second floor including both a room and a stairwell threshold, a stairwell connecting the first floor to the second floor, the stairwell being pressurized, the second floor being in communication with the stairwell via the stairwell threshold, and a floor drainage and water containment assembly including:

a stairwell drain extending below the second floor;

a stairwell trough extending along the stairwell threshold, the stairwell trough being adjacent to and in communication with the room, the stairwell trough being in fluid communication with the stairwell drain, whereby water from the second floor entering the stairwell threshold is at least partially captured by the stairwell trough and directed to the stairwell drain;

an additional stairwell drain;

an additional stairwell trough extending along the stairwell threshold, the additional stairwell trough being adjacent to and in communication with the stairwell and being in fluid communication with the additional stairwell drain, the additional stairwell drain further capturing water from the stairwell that enters the stairwell threshold;

a stairwell pipe having an interior and a divider disposed within the interior of the stairwell pipe, the divider being shaped to split the stairwell pipe into a first part and a second part sealed from the first part, the first part of the stairwell pipe being part of the stairwell drain and the second part of the stairwell pipe being part of the additional stairwell drain;

a catch basin disposed below the second floor, the stairwell drain connecting the stairwell trough to the catch basin and the additional stairwell drain connecting the additional stairwell trough to the catch basin, the stairwell drain being interposed between the stairwell trough and the catch basin, and the additional stairwell drain being interposed between the additional stairwell trough and the catch basin;

a hoistway connecting the first floor to the second floor, the hoistway having a length, the second floor further having a hoistway threshold and being in communication with the hoistway via the hoistway threshold;

a hoistway trough adjacent to and spaced-apart from the hoistway, the hoistway trough extending adjacent to the hoistway threshold and along the entire length of the hoistway;

a hoistway trough drain; and a junction connecting together the stairwell pipe and hoistway trough drain, the hoistway trough being in fluid communication with the hoistway trough drain, whereby water from the second floor seeking to enter the hoistway threshold is at least partially captured by the hoistway trough and directed to the hoistway trough drain.

2. The building as claimed in claim 1, further including a threshold plate for extending along the stairwell threshold, the threshold plate comprising:

a first portion at least partially disposed towards the room and having a plurality of apertures extending therethrough, the apertures positioned to receive water passing over the threshold plate, the first portion operatively connecting to the stairwell drain via said apertures; and a second portion at least partially disposed towards the stairwell landing and having a plurality of apertures extending therethrough, the apertures of the second portion positioned to receive water passing over the threshold plate, the second portion operatively connecting to an additional drain via said apertures of the second portion.

3. The building as claimed in claim 2, wherein the threshold plate is isosceles trapezoid shaped in cross-section.

4. The building as claimed in claim 2, wherein the threshold plate includes a middle portion between its first portion and its second portion, and where in the building further includes a closed door, the threshold being disposed below the closed door.

5. The building as claimed in claim 1, wherein the stairwell trough is formed as part of the second floor and wherein the stairwell drain is cast in place.

6. The building as claimed in claim 1, wherein the hoistway trough is formed as part of the second floor and wherein the hoistway drain is cast in place.

7. The building as claimed in claim 1, the second floor including both a further room and a further stairwell threshold, the building including a further stairwell connecting the first floor to the second floor, the further stairwell being pressurized, the further room being in communication with the further stairwell via the further stairwell threshold, and the floor drainage and water containment assembly further including:

a further stairwell drain extending below the second floor;

a further stairwell trough extending along the further stairwell threshold, the further stairwell trough being adjacent to and in communication with the further room, the further stairwell trough being in fluid communication with the further stairwell drain, whereby water from the second floor entering the further stairwell threshold is at least partially captured by the further stairwell trough and directed to the further stairwell drain;

yet another stairwell drain; and yet another stairwell trough extending along the further stairwell threshold, said yet another additional stairwell trough being adjacent to and in communication with the further stairwell and being in fluid communication with the yet another stairwell drain, the yet another stairwell drain further capturing water from the further stairwell that enters the further stairwell threshold.

8. The building as claimed in claim 7, wherein the further stairwell drain connects the further stairwell trough to the catch basin and the yet another stairwell drain connects the yet another stairwell trough to the catch basin.

* * * * *